US006061012A

United States Patent [19]

Sakimura

[11] Patent Number: 6,061,012

[45] **Date of Patent: *May 9, 2000**

[54] ROTATIONAL HANDY RADAR REFLECTOR

[75] Inventor: Kenjiro Sakimura, Zushi, Japan

[73] Assignee: Sakimura Corporation, Kanagawa, Japan

[ * ] Notice: This patent is subject to a terminal disclaimer.

[21] Appl. No.: 09/171,668

[22] PCT Filed: Feb. 26, 1998

[86] PCT No.: PCT/JP98/00772

§ 371 Date: Oct. 22, 1998

§ 102(e) Date: Oct. 22, 1998

[87] PCT Pub. No.: WO98/38696

PCT Pub. Date: Sep. 3, 1998

[30] Foreign Application Priority Data

Feb. 27, 1997 [WO] WIPO ..... PCT/JP97/00587

[51] Int. Cl.[7] ..... H01Q 15/18; H01Q 15/14; H01Q 15/20

[52] U.S. Cl. ..... 342/5; 342/7; 342/8; 342/10; 343/912; 343/915; 343/916

[58] Field of Search ..... 342/1–12; 343/840, 343/912, 915, 916

[56] References Cited

U.S. PATENT DOCUMENTS 4,241,349 12/1980 Connell ..... 342/7
5,459,468 10/1995 Hartal ..... 342/7
5,933,124 8/1999 Sakimura ..... 343/915

FOREIGN PATENT DOCUMENTS 62-80412 5/1987 Japan .
4341002 11/1992 Japan .
5152833 6/1993 Japan .

OTHER PUBLICATIONS

Technical Reference entitled "Efficiency of Radar Reflector Filled with Helium Gas" to Tokimec Engineering Inc., dated May 21, 1996, 3 pages in Japanese, and 7 pages of English translation.

*Primary Examiner*—Bernarr E. Gregory
*Attorney, Agent, or Firm*—Price, Heneveld, Cooper, DeWitt & Litton

[57] ABSTRACT

Three reflector plates comprising: a lateral reflector plate having two half plates each opposingly placed across a rotation supporting shaft introduced therebetween, a longitudinal reflector plate having two half plates each opposingly placed across the rotation supporting shaft therebetween, and a bottom reflector plate placed at the central portion of the rotation supporting shaft, wherein these three reflector plates are brought into mutual orthogonal intersection at their diameters, and the rotation supporting shaft is provided with an inclination supporting hole with an inclination of a "detection design angle", thereby enabling to maintain the detection design angle when in use and enabling to easily assemble into the shape for use even in case of emergency, and further enabling the reflector plates to be stacked flat one upon another and stored free from bulkiness when not in use.

5 Claims, 14 Drawing Sheets

ROTATIONAL HANDY RADAR REFLECTOR

TECHNICAL FIELD

The present invention relates to a handy reflector used for marine vessels and the like at the time of distress. More particularly, the present invention relates to a rotational handy radar reflector as an all-directional corner reflector used for small marine vessels, FRP (fiber-reinforced plastic) pleasure boats, and the like.

BACKGROUND ART

Small marine vessels and the like are provided with radar reflectors for preventing maritime disaster, and particularly, in congested sea areas, nighttime navigation, under poor weather conditions such as fog and so forth, it is the duty of such marine vessels to sail with radar reflectors mounted.

Conventionally, a so-called all-directional corner reflector capable of catching radar waves from all directions is used, such being comprised of eight triangular corner reflectors, each of these comprising three sides of metal plates which are perpendicular to one another.

However, since such an all-directional corner reflector is formed in such a manner that the three sides of metal plates are constructed as one body, the corner reflector is stored in such a state that the three sides of metal plates remain perpendicular to one another, that is to say, in a three-dimensional state.

As a result, the entire shape of the reflector is so bulky that a greater storage space is required, and also, care must be taken so as not to deform the three sides of the metal plates by bumping them against surrounding objects or by allowing them to be pressed by surrounding objects. In response to this problem, a foldable radar reflector has been developed. (See Japanese Unexamined Utility Model Publication No. 62-80412.)

The aforementioned all-directional corner reflector has limits regarding the angles of incidence and reflection of radar waves, as it can be understood from the shape thereof. With respect to an isosceles triangle corner reflector, it has approximately the same angle of reflection in both the horizontal and longitudinal directions.

Accordingly, the greatest angle of reflection at the width of approximately 40° (−3 dB half-voltage value) is 36° upwards when the triangle serving as the base (bottom reflector plate) is placed flat. (See a technical reference entitled "EFFICIENCY OF RADAR REFLECTOR FILLED WITH HELIUM GAS" issued by Tokimec Engineering Inc. dated May 21, 1996.) Therefore, when the reflector is installed, it is necessary to place the bottom reflector plate at an angle of 36° upward. Incidentally, this upward angle is referred to as a "detection design angle".

However, with respect to the radar reflector according to the conventional example, a string is passed through holes formed in the main reflector plates, and the radar reflector is suspended by attaching the string to a predetermined location. Accordingly, in the event that the radar reflector is subjected to an external force such as the wind, the reflector is swayed at random in up and down directions, forward and backward directions, right and left directions, and so on, so that it is difficult to maintain the bottom reflector plate at the detection design angle. Consequently, it is difficult to catch and reflect radar waves effectively over a wide area.

The object of the present invention is enabling to assemble and install such an all-directional corner reflector at the detection design angle in a precise and yet easy manner.

Another object of the present invention is to provide an all-directional corner reflector which is not bulky for storage.

The other object of the present invention is enabling to surely assemble an all-directional corner reflector from the stored state even in case of emergency.

DISCLOSURE OF INVENTION

The present invention comprises:

a lateral reflector plate having two half plates each opposingly placed on the right and left sides of a rotation supporting shaft introduced therebetween, a longitudinal reflector plate having two half plates each opposingly placed at the top and bottom of the rotation supporting shaft therebetween, wherein the lateral reflector ate and the longitudinal reflector plate are vertical to each other, and a bottom reflector plate arranged to perpendicularly intersect both the lateral reflector plate and longitudinal reflector plate so that the bottom reflector plate partitions off the lateral reflector plate and the longitudinal reflector plate into half in the direction perpendicular to the axis of the rotation supporting shaft, thereby forming eight corner reflectors of the same shape.

The rotation supporting shaft is provided with an inclination supporting hole at the center portion thereof with an inclination of a "detection design angle" against the center axis of the rotation supporting shaft. A supporting member, for example, a vertical pole of its fore end is inserted into the supporting hole, thereby rotatably supporting the rotation supporting shaft on the pole.

When this pole is raised, the bottom reflector plate of the aforementioned reflector assumes the inclination of "the detection design angle" against a horizontal line which intersects at right angles the center axis of the pole. At the same time, the rotation supporting shaft is rotatably supported on the pole while maintaining the inclination of the detection design angle against the pole. Thus, radar waves can be reflected in all directions.

BEST MODE FOR CARRYING OUT THE INVENTION

Figure 1:
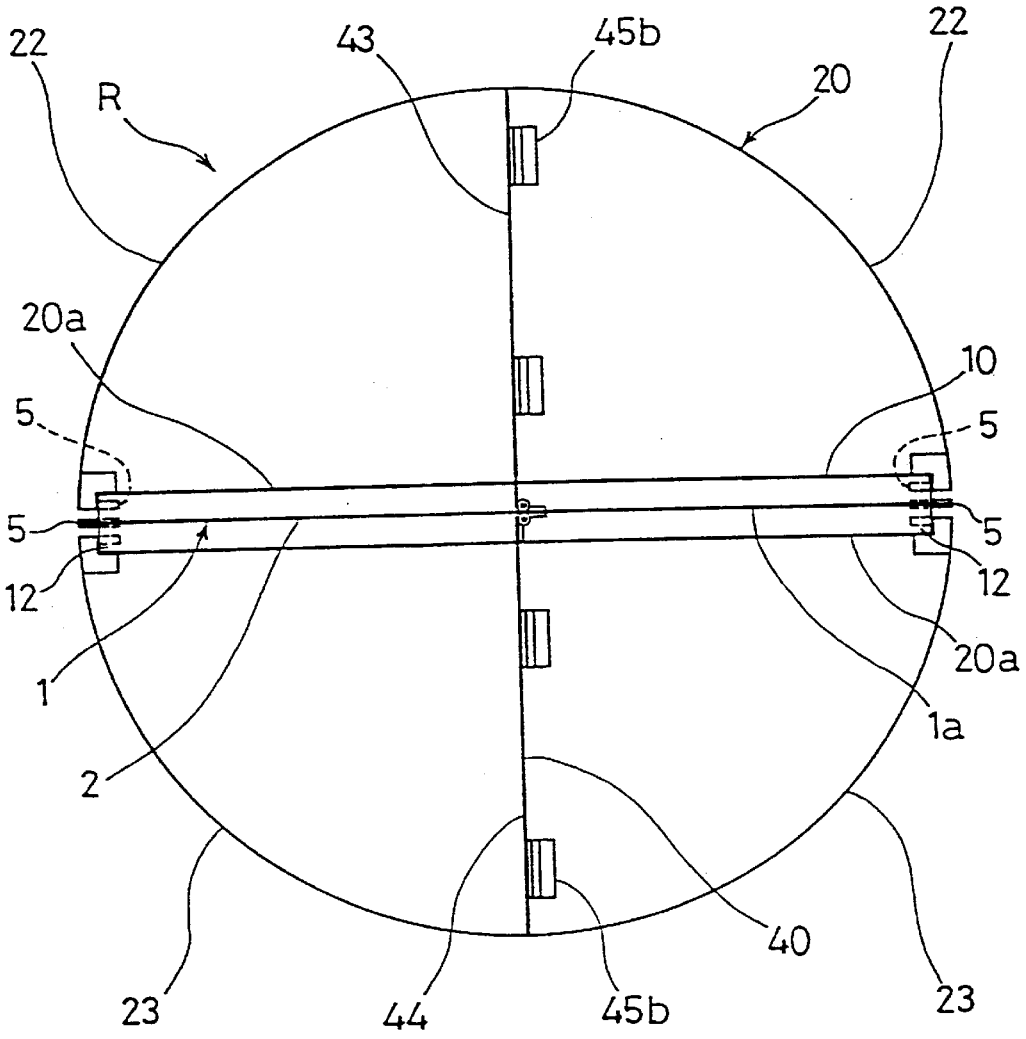
FIG. 1 is a front view illustrating the first embodiment of the present invention.

The first embodiment of the present invention will be described with reference to FIG. 1 through FIG. 12.

The lateral reflector plate 1 and longitudinal reflector plate 20 and bottom reflector plate 40 are brought into mutual orthogonal intersection at their diameters, thereby forming eight corner reflectors A of the same shape.

The longitudinal reflector plate 20 is of a stainless-steel circular plate, with the diameter thereof being, e.g., 440 mm. This longitudinal reflector plate 20 is comprised of two half plates 22 and 23 which are semicircular and opposed across a rotation supporting shaft 10 therebetween, and provided to both opposite ends of the diametrical edges 20*a*, 20*a* of these half plates 22 and 23 are retaining means, e.g.,retaining clays 5, 5.

The lateral reflector plate 1 is of a stainless-steel circular plate, with the diameter thereof being, e.g., 440 mm. This lateral reflector plate 1 is comprised of two half plates 2 and 3 which are semicircular and opposed across the rotation supporting shaft 10 therebetween, and provided to both opposite ends of the diametrical edges 1*a*, 1*a* of these plates 2 and 3 are retaining means, e.g., retaining claws 5, 5. These retaining claws 5, 5 are hooked onto both opposite edges of the rotation supporting shaft 10 which is cylindrical.

The half plates 2 and 3 of the lateral reflector plate 1 are of the same shape as the half plates 22 and 23 of the longitudinal reflector plate 20.

The bottom reflector plate 40 is comprised of four stainless-steel quarter plates 41, 42, 43, and 44, each being a quarter-circle. Three of the four quarter plates, 41 through 43 are each comprised of a pair of-pieces 40*p*, each of the pieces being an eighth of a circle, and the apex angle $\alpha$ of each of the quarter plates 41 through 43 is formed to be 90°.

Each pair of the pieces 40*p* are rotatably linked to each other via folding portion 45 formed in the radius direction, with hinges 45*a*, 45*a* being used for the folding portion 45.

As to the three quarter plates 41 through 43, the side edges thereof are each linked to the half plates 2, 3, 22, and 23 by hinges 45*b*, 45*b*.

Figure 2:
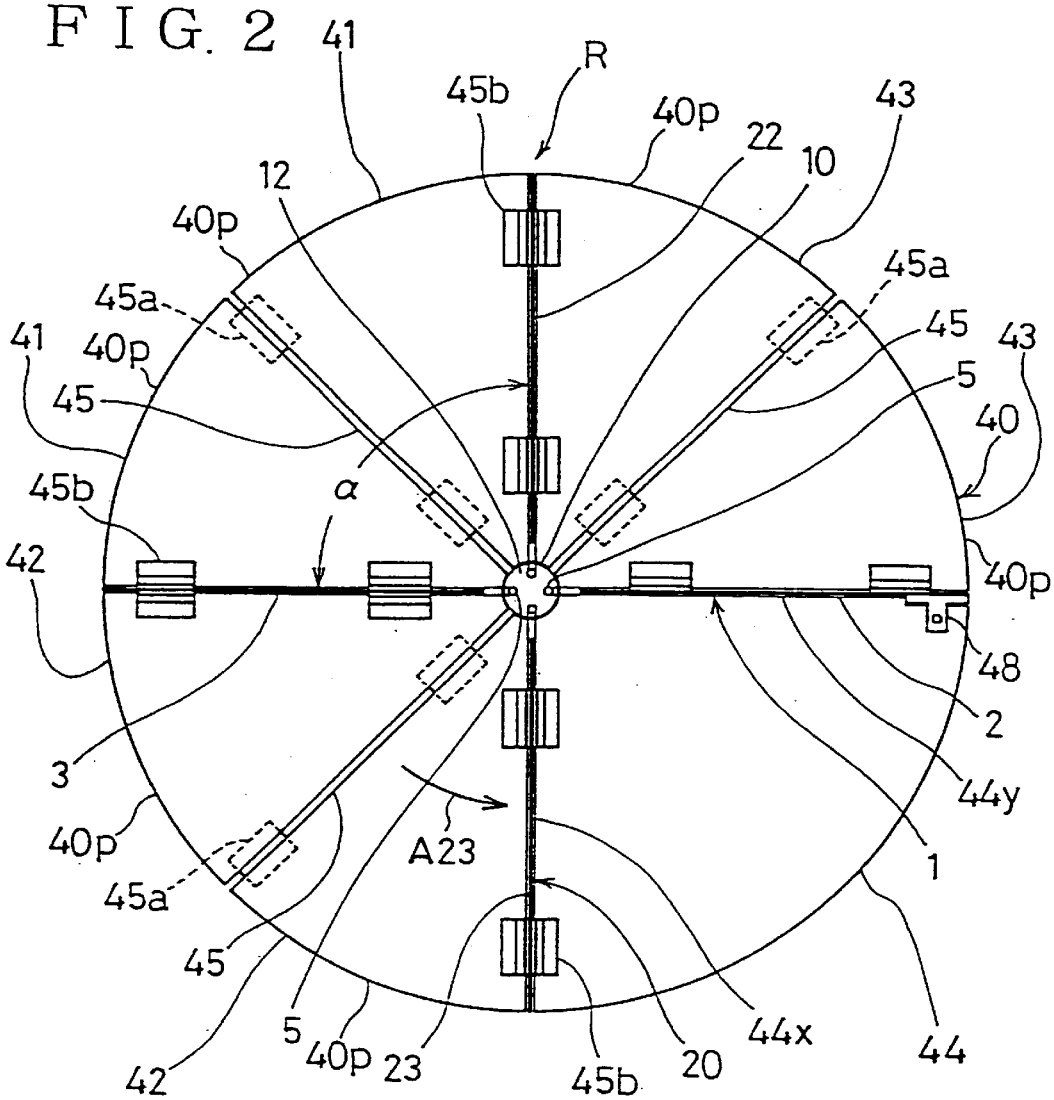
FIG. 2 is a side view illustrating the first embodiment of the present invention.
Figure 3:
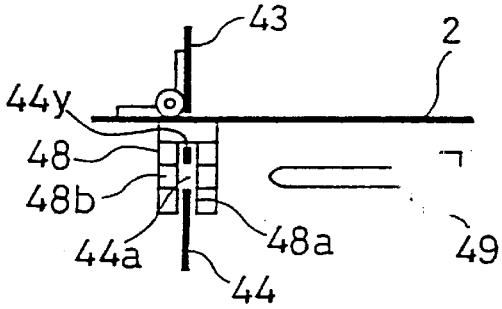
FIG. 3 is an enlarged side view of the principal components of FIG. 2.
Figure 4:
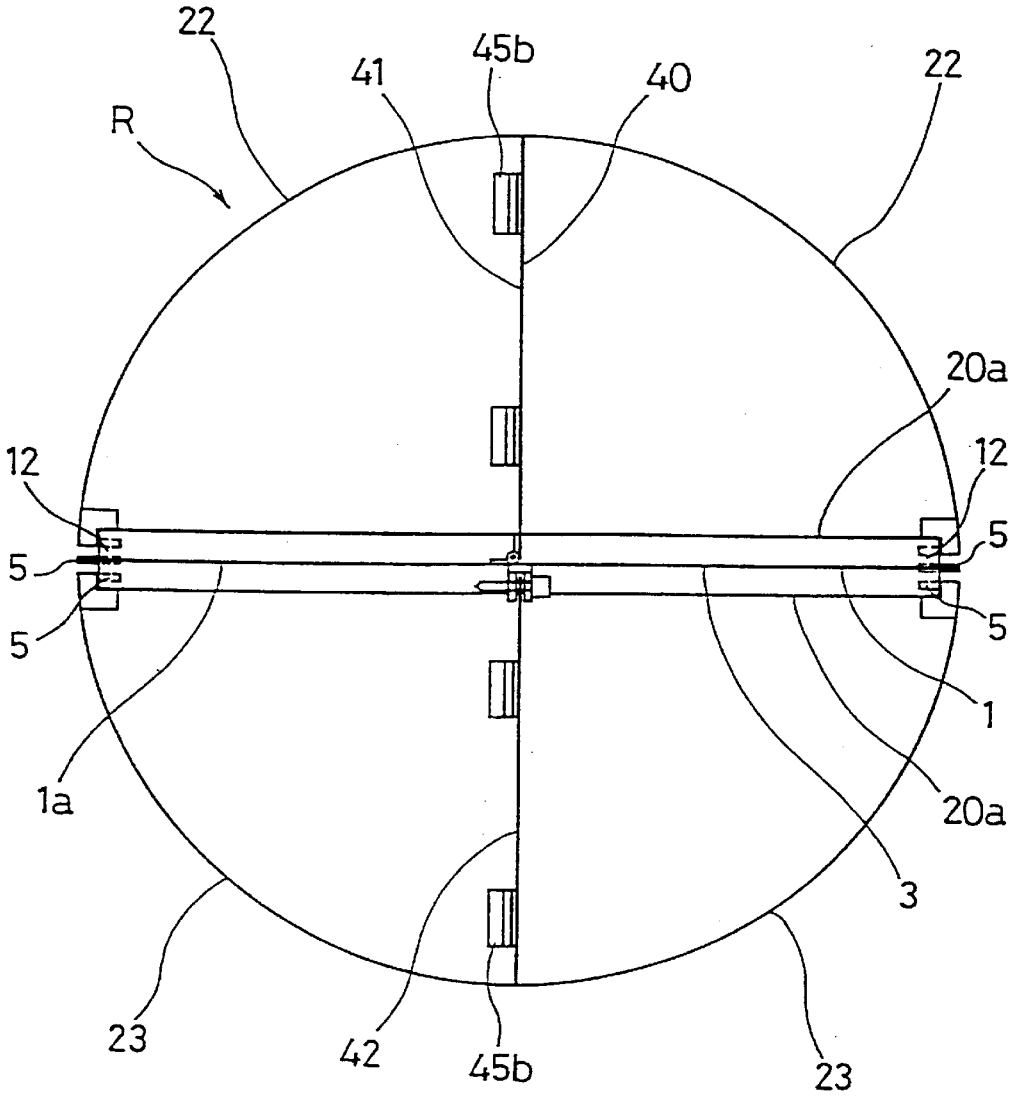
FIG. 4 is a rear view illustrating the first embodiment of the present invention.
Figure 6:
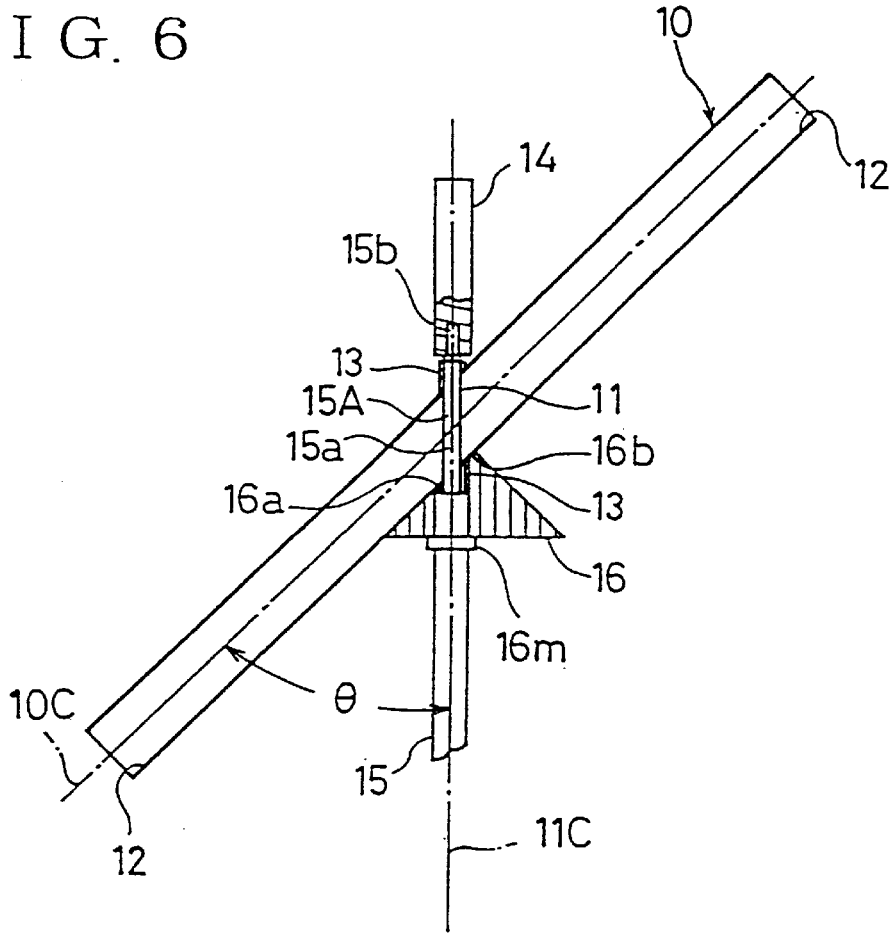
FIG. 6 is a cross-sectional view illustrating the state of the pole in use.

The quarter plate 44 is linked at one side edge 44*x* to the half plate 23 by means of hinges 45*b*, 45*b* and provided to the other side edge 44*y* is linking means, for example, a pin hole 44*a* as shown in FIG. 3 is provided which is retained to a receiving member 48 as shown in FIG. 2 by means of a pin 49. This retaining member 48 is fixed to the half plate 2, and is provided with a quarter plate insertion groove 48*a* and a through hole 48*b*. The rotation supporting shaft 10 is of a hollow cylindrical form, with an inclination supporting hole 11 provided in the center thereof for insertion of a pole 15 thereto as shown in FIG. 6. Hollow receiving portions 12, 12 are provided on both opposite ends of the rotation supporting shaft 10 for rotatably supporting the retaining claws 5, 5.

The center axis 11C of the inclination supporting hole 11 is of a detection design angle $\theta$ against the center axis 10C of the rotation supporting shaft 10. This detection design angle $\theta$ will be described in detail later.

Figure 5:
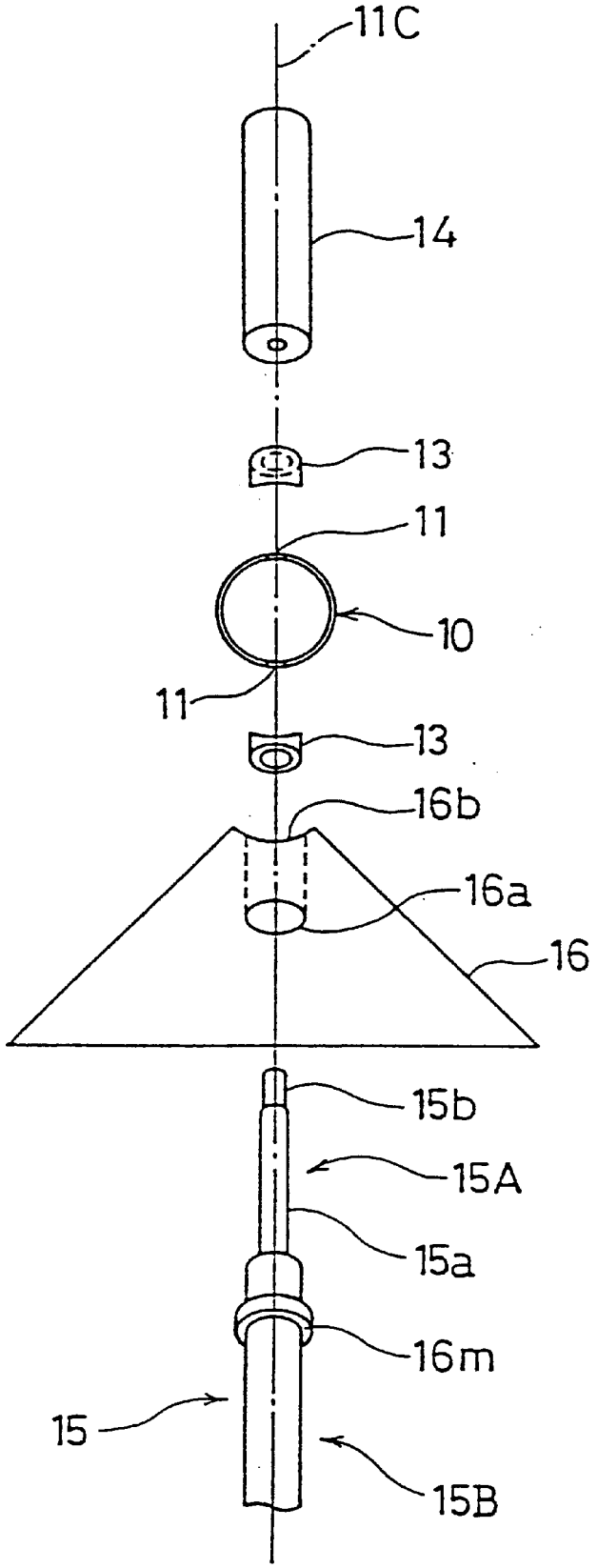
FIG. 5 is a perspective view illustrating a pole inserting member.

Cylindrical bearings 13, 13 are fixed at an entrance and exit of the inclination supporting hole 11 as shown in FIGS. 5 and 6.

The tip portion 15A of the pole 15 is movably fitted into this inclination supporting hole 11. This tip portion 15A is formed so as to be smaller in diameter than the main body portion 15B of the pole 15, with a threaded portion 15*b* for screwing a retaining nut 14 onto being provided on the tip of the insertion portion 15*a*, and with a receiving portion 16*m* being provided to the rear end portion thereof, this receiving portion 16*m* supporting an inclination fixing block 16.

The center axis of the insertion hole 16*a* of the inclination fixing block 16 overlaps with the center axis 11C of the inclination supporting hole 11. This inclination fixing block 16 is provided with a receiving portion 16*b* on the upper surface thereof.

This receiving portion 16*b* is formed so as to have an arc-shaped cross-sectional form which corresponds in shape with the outer circumferential surface of the rotation supporting shaft 10, and when the pole 15 is inserted into the inclination supporting hole 11, surface-to-surface contact is made with the outer circumferential surface of the rotation supporting shaft 10, thereby firmly supporting. Accordingly, it is ensured that both of the center axes 10C and 11C maintain to intersect each other at the detection design angle $\theta$. The lower end of this inclination fixing block 16 is rotatably supported by the pole receiving portion 16*m*.

The main body 15B of the pole 15 is comprised of a first pole 15*e* and a second pole 15*f* linked by a folding portion 15C. The poles 15*e* and 15*f* are each comprised of a storage portion 15*h* and an extending portion 15*k* respectively.

The length 15L of the poles 15*e* and 15*f* when retracted is selected appropriately according to the need. For example, the length 15L is made to be 500 mm, and the length of each of the poles 15*e* and 15*f* when the extending portion 15*k* is extended is made to be 2500 mm.

The folding portion 15C is provided with an arm 15*n* which is axially fixed to the end portions of both poles 15*e* and 15*f*, and stoppers 15*m*, 15*m*. These stoppers 15*m*, 15*m* are cylindrical members slidably fit on to the end portions of the poles 15*e* and 15*f* respectively in the direction along the center axis 11*c*, and they restrict the folding of the pole 15 by sliding the stoppers 15*m*, 15*m* from the positions shown in FIG. 8 to the positions shown in FIG. 7.

Figure 10:
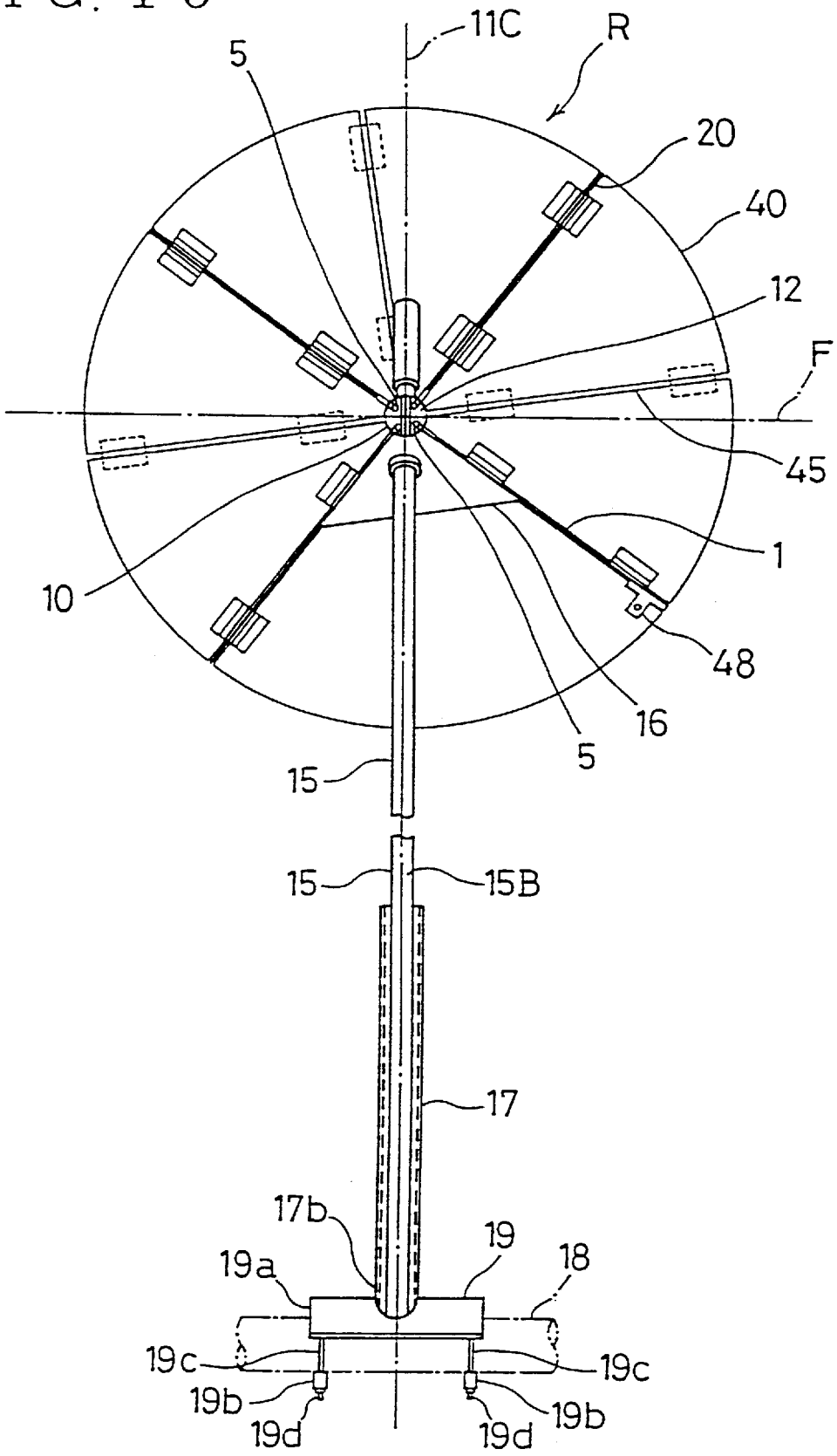
FIG. 10 is a side view illustrating the state of the handy reflector in use.
Figure 11:
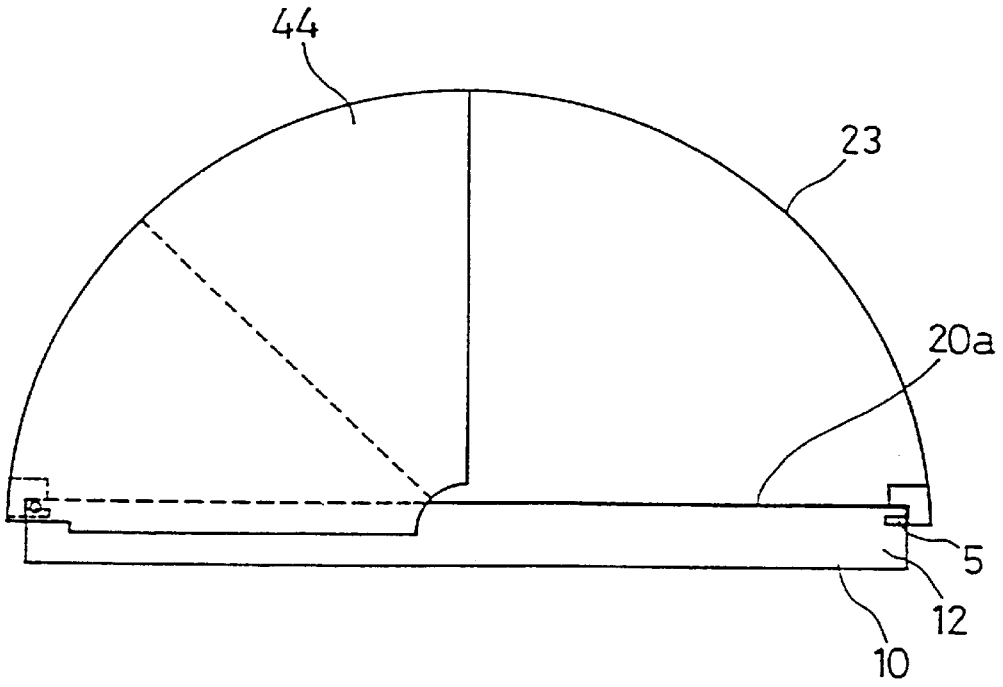
FIG. 11 is a plan view illustrating the folded state of the handy reflector.
Figure 12:
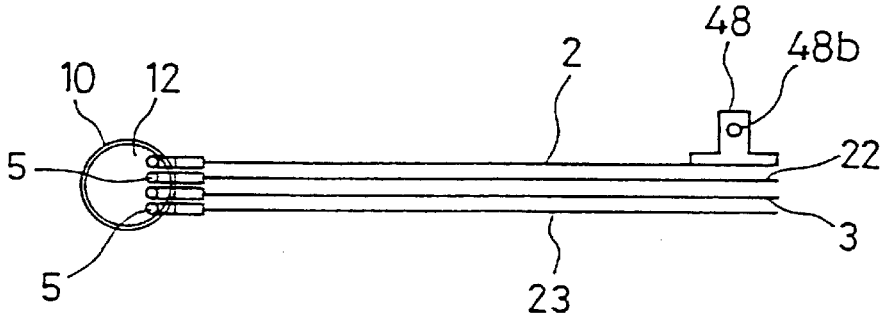
FIG. 12 is a side view illustrating the folded state of the handy reflector.

The storing portion 15*h* of the second pole 15*f* is inserted into the holder 17 as shown in FIG. 10. This holder 17 is formed to have a diameter slightly larger than that of the pole 15, and the length thereof is made to be, e.g., 500 mm. A fixing metal fitting 19 is provided to the lower end 17*b* of this holder 17. This fixing metal fitting 19 is provided with upper and lower pressing plates 19*a* and 19*b* for pinching a horizontal railing 18, and bolts 19*c*, 19*c* for linking the pressing plates 19*a* and 19*b*, with the pressing plates 19*b* being tightened by rotating nuts 19*d*, 19*d* provided to the bolts 19*c*, 19*c* in a certain direction, thus conducting fixing to the railing 18.

Next, the aformentioned "detection design angle θ" will be described.

Figure 9:
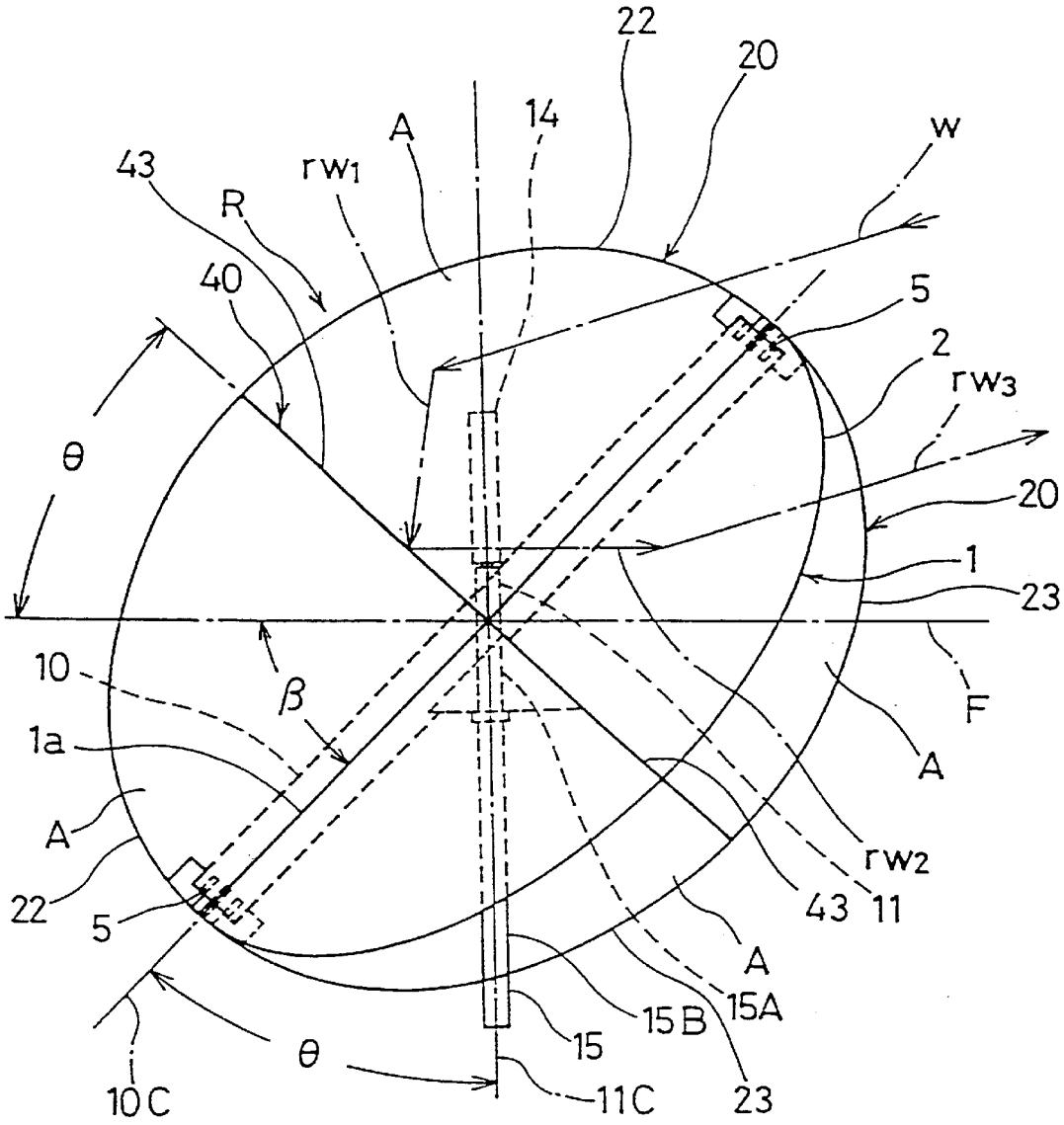
FIG. 9 is a perspective view illustrating the state of the handy reflector in use.

This angle θ is the angle of the bottom reflector plate 40 of the all-directional corner reflector R against the horizontal line F when the tip portion 15A of the pole 15 is inserted into the inclination supporting hole 11 and the pole 15 is raised in a longitudinal state as shown in FIG. 9, i.e., when the center axis 11C of the inclination supporting hole 11 is vertical.

As shown in FIG. 9, with an all-directional corner reflector R, the angle of intersection of the center axis 11C and the horizontal line F is β+θ=90° and also, the angle of intersection of the quarter plate 43 of the bottom reflector plate 40 and the center axis 10*c* is β+θ=90°.

Accordingly, the detection design angle θ is the same angle θ as the angle of intersection between the center axis 10C of the rotation supporting shaft 10 and the center axis 11*c* of the inclination supporting hole 11, and thus it can be understood that the angle of the bottom reflector plate 40 against the horizontal line F becomes the detection design angle θ in an arrangement wherein the center axis 11C of the inclination supporting hole 11 intersects the center axis 10C at the angle θ. This angle θ is appropriately selected according to the types of all-directional corner reflectors. For example, the angle θ=36° is selected for isosceles triangle corner reflectors, and the angle θ=35° is selected for square corner reflectors.

Next, the operation of this embodiment will be described.

First, description will be made regarding setting up of the all-directional corner reflector R which is in a folded and stored state.

As shown in FIG. 10, the holder 17 is fixed to a horizontal railing 18 beforehand by a fixing metal fitting 19.

The reflector is carried from a storage location to the position of the holder 17, and at the same time, as shown in FIG. 2 the half plate 2 of the lateral reflector plate 1 and the half plate 23 of the longitudinal reflector plate 20 are held and the half plate 23 is rotated around the rotation supporting shaft 10 in the direction indicated by an arrow A23 to distance from the half plate 2, causing the half plate 23 to move in the same direction indicated by the arrow A23 while pulling the quarter plates 41 through 43, so that the lateral reflector plate 1 and the longitudinal reflector plate 20 each becomes a circular flat plane, and so that both plates 1 and 20 intersect orthogonally each other opposed across the rotation supporting shaft 10 therebetween. At this time, the quarter plates 41, 42, and 43 become flat plane quarter plates with the apex angle α of 90° that cannot be stretched any further, so the half plate 23 cannot be rotated any further.

In this state, as shown in FIG. 3, a side edge 44*y* of the quarter plate 44 is inserted into an insertion groove 48*a* of a receiving member 48, and a pin 49 is inserted into both a through hole 48*b* and a pin hole 44*a* so as to fix the quarter plate 44. Thus, eight quarter-circle corner reflectors A are formed, thereby forming an all-directional corner reflector R.

As shown in FIG. 6, an insertion portion 15*a* of the tip portion 15A of the pole 15 is fit into the inclination supporting hole 11 of the rotation supporting shaft 10, and brought into contact with a receiving portion 16*b* of the inclination fixing block 16, and at the same time, a retaining nut 14 is screwed to a threaded portion 15*b l of the pole 15.*

Figure 8:
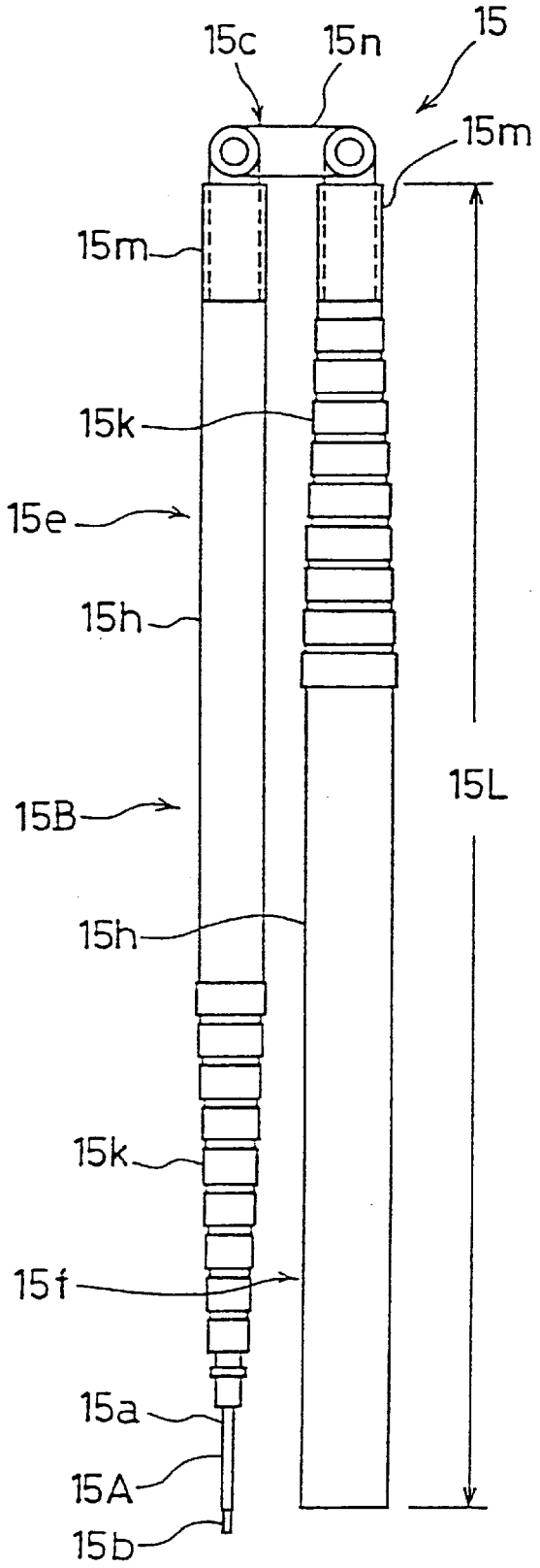
FIG. 8 is a front view illustrating the stored state of the pole.

Subsequently, the storage portion 15*h* of the second pole 15*f* as shown in FIG. 8, is inserted into the holder 17 as shown in FIG. 10.

Figure 7:
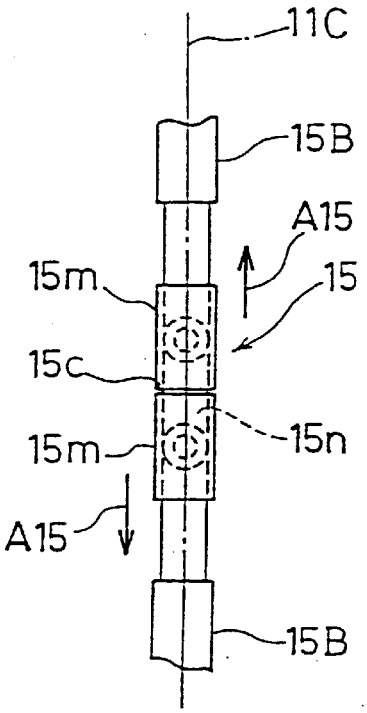
FIG. 7 is a front view illustrating the partial portion of the pole in use.

As shown in FIG. 7, the stoppers 15*m*, 15*m* of the folding portion 15C are slid so as to fix the arm 15*n* and the respective end portion of the poles 15*e* and 15*f* in a straight line, and at the same time, the extending portion 15*k* of the pole 15 is extended and when the length thereof reaches the predetermined length, e.g., 5000 mm, the all-directional corner reflector R is thereby situated in the predetermined position. Hence, the all-directional corner reflector R is rotatably mounted on the center axis 11*c* at the predetermined position, maintaining the detection design angle θ.

Radar wave W is emitted from a radar (not shown), and as shown in FIG. 9 when there is an incidence of the radar wave W to any one of the eight quarter corner reflectors A of the all-directional corner reflector R, the radar wave W collides with one of the three orthogonal reflector plates, i.e., the half plates 2, 22, or quarter plate 43, for example, on the reflector surface of the half plate 22 of the longitudinal reflector plate 20, and becomes the first reflected wave rw1.

This first reflected wave rw1 further collides with the reflector surface of the quarter plate 43 and reflects, and becomes the second reflected wave rw2. This second reflected wave rw2 collides with the reflector surface of the half plate 2 and reflects, and becomes the third reflected wave rw3. This third reflected wave rw3 reflects in the reverse direction of the incidence of the radar wave W.

Hence, the radar wave W is reflected thrice, returns to the direction that the radar wave W comes from, and is caught by radar.

Second, in order to store the reflector R of which use has been completed, the aforementioned procedure is reversed, i.e., the extending portion 15*k* shown in FIG. 8 of the pole 15 is returned to the original length, the retaining nut 14 shown in FIG. 6 is removed and the leading portion 15A of the pole 15 is removed from the inclination supporting hole 11 of the rotation supporting shaft 10, and at the same time, the stoppers 15*m*, 15*m* are slid respectively in the directions indicated by arrows A15, A15 in FIG. 7, and the pole 15 is folded in half as shown in FIG. 8.

Next, as shown in FIG. 3, the pin 49 is removed and the quarter plate 44 is removed from the receiving member 48, and as shown in FIG. 2 the half plates 2, 22, and 23 are rotated around the rotation supporting shaft 10 in the reverse direction of the direction indicated by the arrow A23, causing the half plates 2, 22, and 23 to move in the direction of approaching the half plate 2 while folding up the intervening quarter plates 41 through 43. At this time, the quarter plates 41 through 43 are folded from the hinges 45*a*, 45*a* of the folding portions 45, 45, so that the all-directional corner reflector R is stacked flat one upon another on the half plate 2, and reduced in size as shown in the plan view of FIG. 11 and the side view of FIG. 12.

Thus folded reflector and the pole 15 which has been collapsed back to the original length are placed into a storage case (not shown) and stored.

The second embodiment of the present invention will be described with reference to FIG. 13 through FIG. 18.

Figure 13:
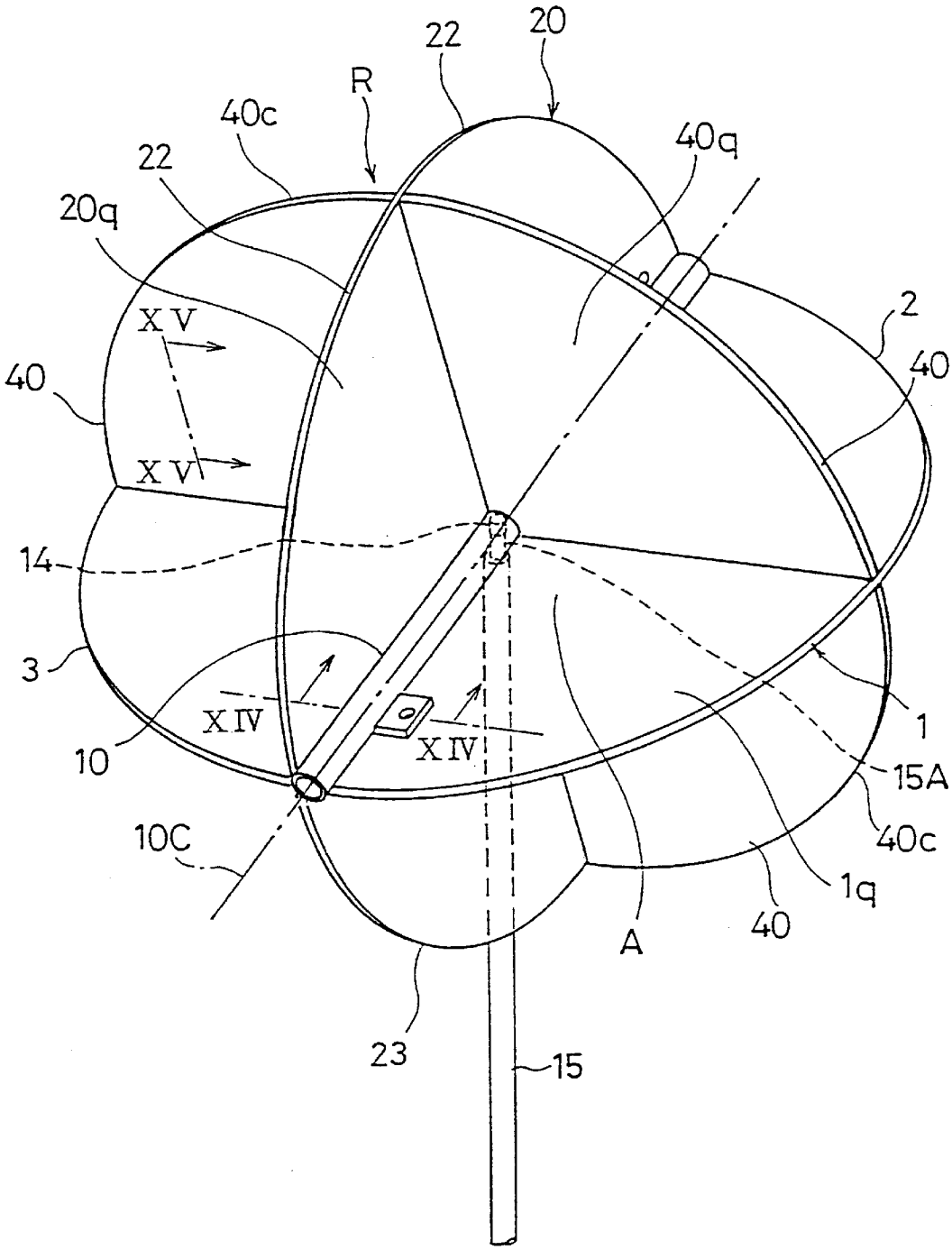
FIG. 13 is a perspective view illustrating the state of the handy reflector in use according to the second embodiment of the present invention.

As shown in FIG. 13, an all-directional corner reflector R is formed of three circular reflector plates of the same shape comprising a lateral reflector plate 1 and longitudinal reflector plate 20 and bottom reflector plate 40 which are brought into mutual orthogonal intersection at their diameters so that each of the reflector plates 1, 20 and 40 is partitioned off into quarters, thereby forming eight corner reflectors A, wherein each of the corner reflectors A is surrounded by quarter planes 1*q*, 20*q*, and 40*q* which are formed by the above-mentioned intersection, and each of the quarter planes having a sector shape.

Figure 16:
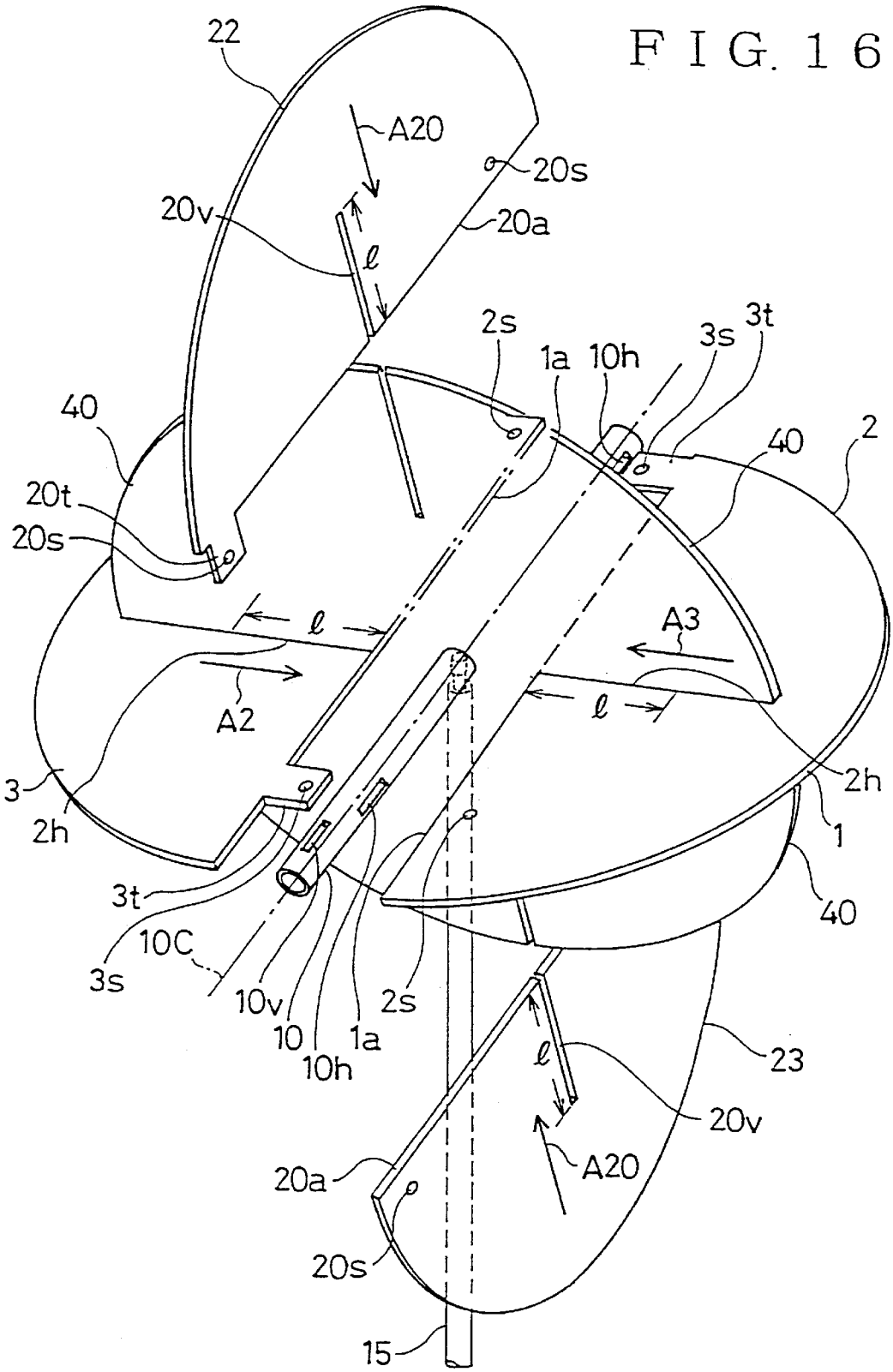
FIG. 16 is a perspective view illustrating another state of FIG. 13.

The lateral reflector plate 1 is comprised of two half plates 2 and 3 which are semicircular and each opposingly placed on the right and left sides of a rotation supporting shaft 10 therebetween as shown in FIGS. 13 and 16, and the longitudinal reflector plate 20 is comprised of two half plates 22 and 23 which are semicircular and each opposingly placed at the top and bottom of the rotation supporting shaft 10 therebetween. The bottom reflector plate 40 is comprised of a disk 40*c* which perpendicularly intersects the rotation supporting shaft 10 at its central portion as shown in FIGS. 13, 16, and 17.

Figure 17:
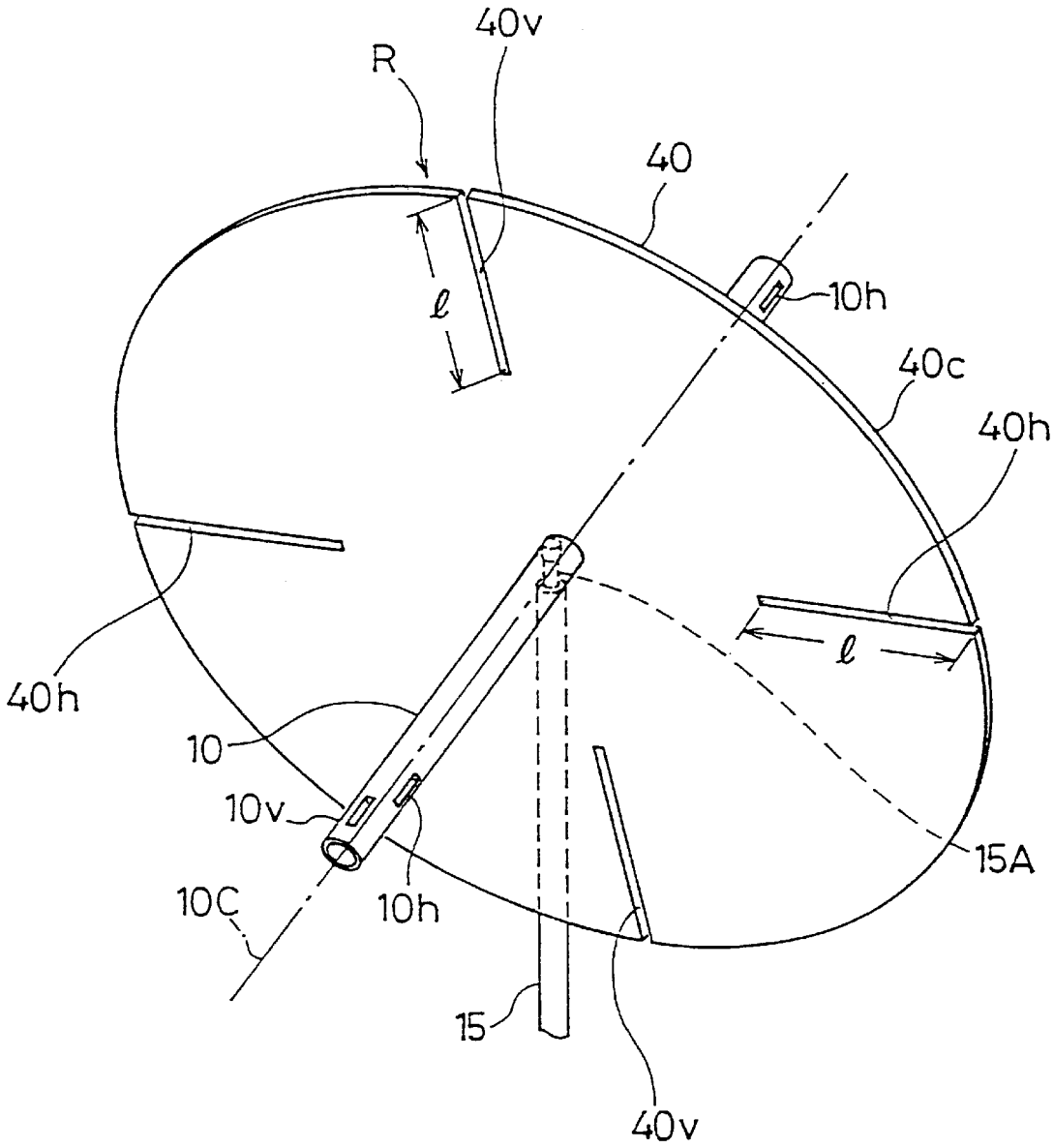
FIG. 17 is a perspective view illustrating another state of FIG. 16.

As shown in FIG. 17, the bottom reflector plate 40 is provided with horizontal slits 40*h*, 40*h*, and vertical slits 40*v*, 40*v* wherein each of the horizontal slits 40*h*, 40*h* is formed at the right and left ends of the horizontal diameter (not shown) in the direction from the circumferential edge to the center with a half length of the radius as indicated by l and each of the vertical slits 40*v*, 40*v* is formed at the upper and lower ends of the vertical diameter (not shown) in the direction from the circumferential edge to the center.

As shown in FIG. 16, the half plates 2 and 3 which comprise the lateral reflector plate 1 are each provided with a horizontal slit 2*h* formed on the radius which is vertical to the diametrical edge 1*a* of the half plates 2 and 3 respectively in the direction from the center to the circumference with a half length of the radius as indicated by l.

The half plates 22 and 23 which comprise the longitudinal reflector plate 20 are each provided with a vertical slit 20*v* formed on the radius which is vertical to the diametrical edge 20*a* of the half plates 22 and 23 respectively in the direction from the center to the circumference with a half length of the radius as indicated by l.

Then, the horizontal slits 2*h*, 2*h* of the half plates 2 and 3 comprising the lateral reflector plate 1 are inserted into the horizontal slits 40*h*, 40*h* of the bottom reflector plate 40 by sliding the respective horizontal slits 2*h*, 2*h* in the directions as indicated by arrows A2 and A3 as shown in FIG. 16 until they mesh with each other as shown in FIG. 13.

At this time, a tongue-like projecting portion 3*t* formed at the half plate 3 is inserted into a horizontally-opened long through hole 10*h*, which is bored through the sides of the rotation supporting shaft 10, until a bolt hole 3*s* formed in the tip of the tongue-like projecting portion 3*t* appears from the other side of the rotation supporting shaft 10. Then, a bolt hole 2*s* formed in the other half plate 2 is placed onto the bolt hole 3*s* and a fitting member 2*p* is passed through the bolt holes 2*s* and 3*s*, thereby fixing the half plates 2 and 3 to each other. At the same time, a tongue-like projecting portion 3*t* formed at-the half plate 2 is fixed to the half plate 3 with a fitting member 2*p* in the same manner, thereby forming the lateral reflector plate 1 of circular shape.

Then, the vertical slits 20*v*, 20*v* of the half plates 22 and 23 comprising the longitudinal reflector plate 20 are inserted into the vertical slits 40*v*, 40*v* of the bottom reflector plate 40 by sliding the respective vertical slits 20*v*, 20*v* in the directions as indicated by arrows A20 and A20 as shown in FIG. 16 until they mesh with each other as shown in FIG. 13.

Figure 14:
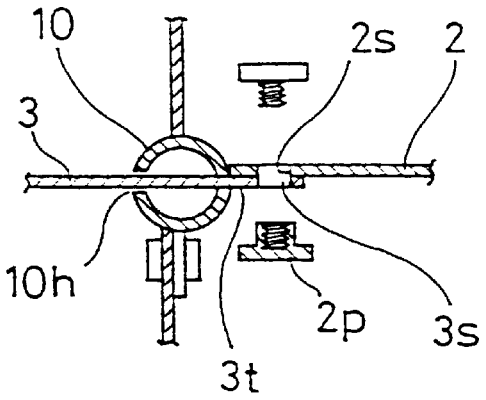
FIG. 14 is an enlarged cross-sectional view taken along the line XIV—XIV of FIG. 13.

At this time, a tongue-like projecting portion 20*t* formed at the upper half plate 22 is inserted into a vertically-opened long through hole 10*v*, which is bored through the top side to the bottom side of the rotation supporting shaft 10, until a bolt hole 20*s* formed in the tip of the tongue-like projecting portion 20*t* appears from the bottom side of the rotation supporting shaft 10. Then, a bolt hole 20*s* formed in the lower half plate 23 is placed onto the bolt hole 20*s* of the upper half plate 22 and a fitting member 2*p* shown in FIG. 14 is passed-through these bolt holes 20*s*, 20*s*, thereby fixing the half plates 22 and 23 to each other. At the same time, a tongue-like projecting portion 20*t* (not shown) formed at the half plate 23 is fixed to the half plate 22 with a fitting member 2*p* in the same manner, thereby forming the longitudinal reflector plate 20 of circular shape.

At this time, since all the reflector plates are meshed with each other at their slits formed in their radial directions, it is possible to make them orthogonally intersect each other easily and accurately even in case of emergency.

Figure 18:
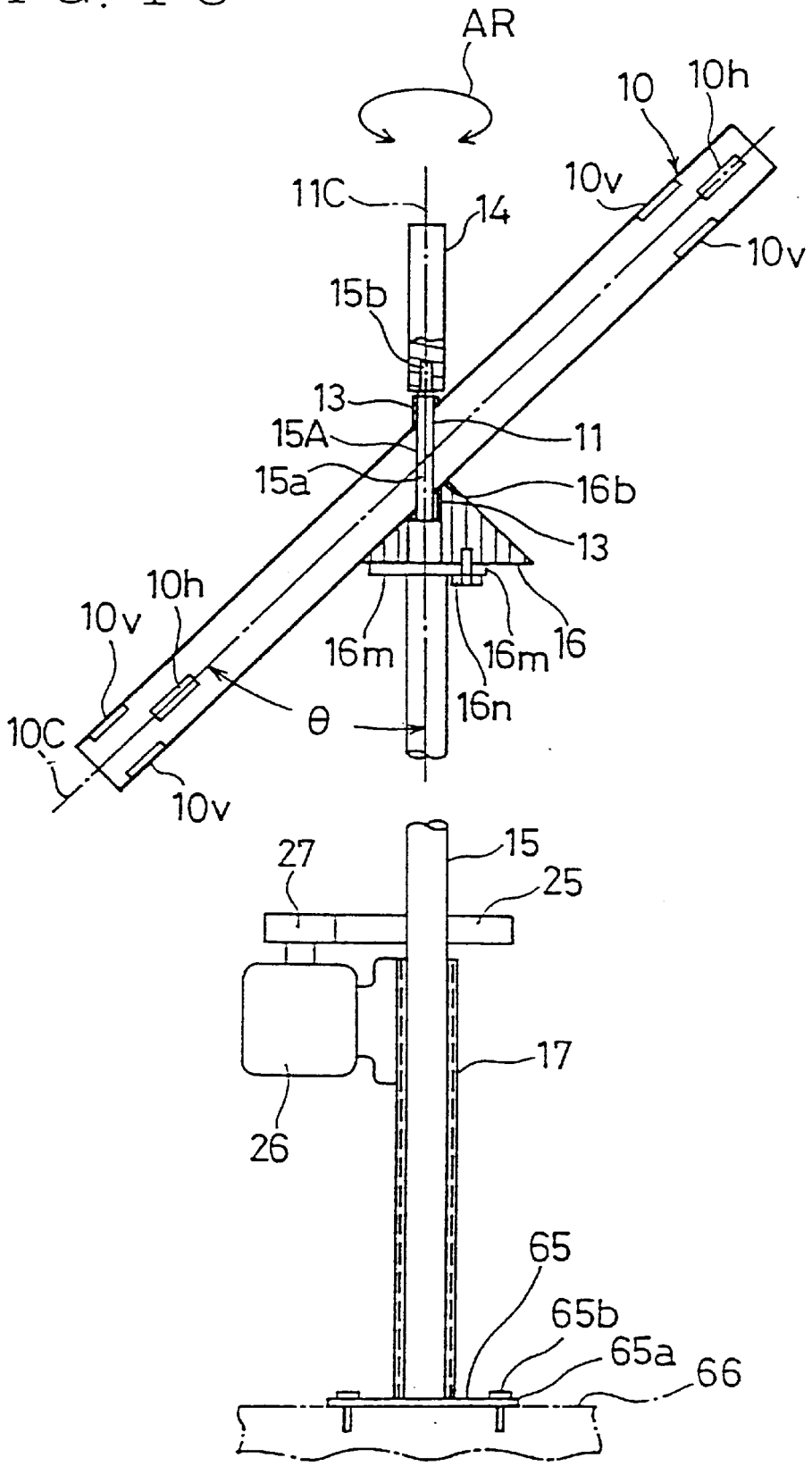
FIG. 18 is a partial sectional front view showing another embodiment of the components shown in FIGS. 5 and 6.

Thus, the all-directional corner reflector R as shown in FIG. 13 is assembled and the tip portion 15A of the pole 15 is fit into the inclination supporting hole 11 which inclines at the same angle as the detection design angle θ against the center axis 10*c* of the rotation supporting shaft 10 as shown in FIG. 18, and a retaining nut 14 is screwed to the tip of the pole 15. A receiving portion 16*m* is provided to the base end of the tip portion 15A, and an inclination supporting block 16 is provided at a slanting space defined between the receiving portion 16*m* and the rotation supporting shaft 10, and the receiving portion 16*m* is fixed to the inclination supporting block 16 with a fixing bolt 16*n*.

Furthermore, as shown in FIG. 18, a driven gear 25 is fixed to the pole 15, and a motor 26 is fixed to the holder 17. Then, a driving gear 27 of the motor 26 is engaged with the driven gear 25.

By starting the motor 26, the pole 15, the rotation supporting shaft 10 and the all-directional corner reflector R which are unitedly connected to the pole 15 are rotated with 60 to 120 revolutions per minute around the center axis 11*c* of the pole 15 in the direction indicated by an arrow AR. Radar wave W incident on the reflector during the rotations reflects in the reverse direction of the incidence in the same manner as shown in FIG. 9.

Or, by leaving the fixing bolt 16*n* unattached, the rotation supporting shaft 10 can be rotated freely on the insertion portion 15*a* of the pole 15 regardless of the rotations of the pole 15. Therefore, the corner reflector R can be used by allowing it to be rotated freely by the force of the wind without using the motor 26.

However, the third reflected wave rw3 is more stable with the motor 26 rotating the all-directional corner reflector R.

Figure 15:
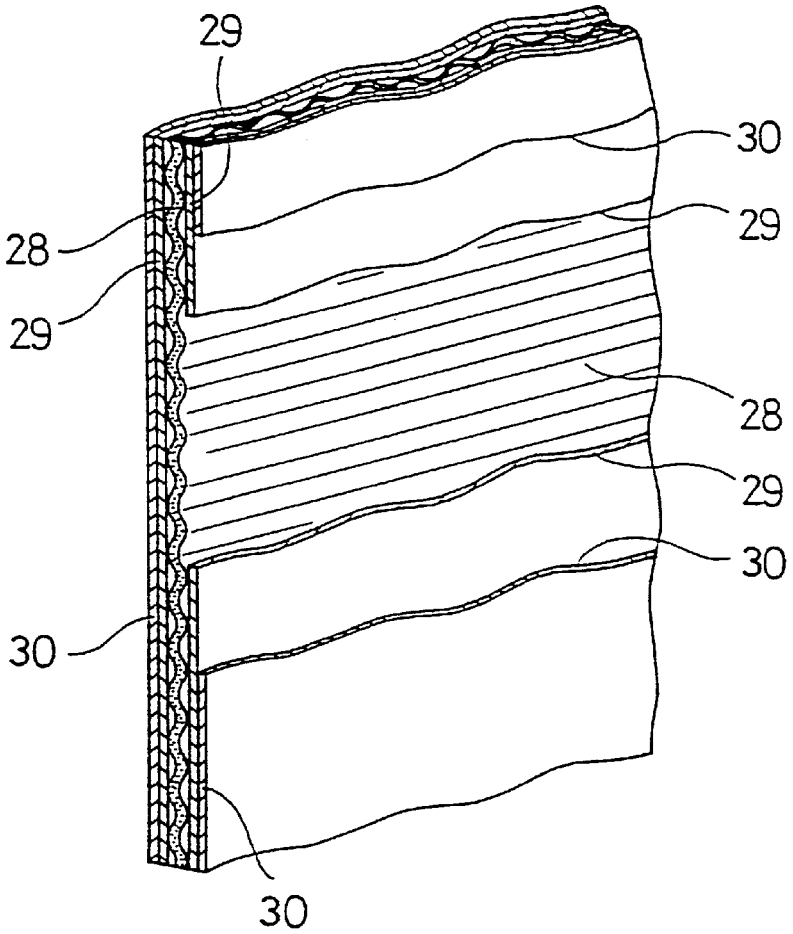
FIG. 15 is an enlarged cross-sectional view taken along the line XV—XV of FIG. 13.

Furthermore, the lateral reflector plate 1 and longitudinal reflector plate 20 and bottom reflector plate 40 which comprise the above-described all-directional corner reflector R are made of the components as shown in FIG. 15 comprising a corrugated plate 28 made of synthetic resin such as polyethylene, flat plane plates 29, 29 formed on both sides of the corrugated plate 28 of the same nature, and metal foil 30 such as aluminum foil or tin foil and the like formed on the flat plane plates 29 and 29.

In order to store the all-directional corner reflector R in the state as shown in FIG. 13 which use is not required, the fitting member 2*p* connecting the half plates 2 and 3 which comprise the lateral reflector plate 1 is removed, and the half plates 2 and 3 are pulled in the reverse directions of the directions indicated by the arrows A2 and A3 of FIG. 16, thereby removing the half plates 2 and 3 from the rotation supporting shaft 10. In the same manner, the fitting member 2*p* connecting the half plates 22 and 23 which comprise the longitudinal reflector plate 20 is removed, and the half plates 22 and 23 are pulled in the reverse directions of the directions indicated by the arrows A20 and A20 of FIG. 16, thereby removing the half plates 22 and 23 from the rotation supporting shaft 10. Then, the rotation supporting shaft 10 is pulled in the axial direction thereof, thereby pulling the rotation supporting shaft 10 out of the bottom reflector plate 40. The half plates 2, 22, 3, 23 and the bottom reflector plate 40 of their flat surfaces are stacked flat one upon another and stored so as not to be bulky.

Incidentally, among the drawing symbols used in FIGS. 13 to 18 which show the second embodiment, the same drawing symbols used in common in FIGS. 1 to 12 which show the first embodiment represent the same names and functions of the corresponding portions.

Industrial Applicability

The present invention relates to a rotational handy radar reflector which is portable and can be stored so as not to be bulky when not in use in peacetime without an emergency of sea distress and the like, and which can be assembled easily into the state of an all-directional corner reflector even in case of emergency. Therefore it is useful for marine vessels, especially for small marine vessels, FRP (fiber-reinforced plastic) pleasure boats, and the like in case of sea distress.

What is claimed is:

1. A rotational handy radar reflector comprising:

a lateral reflector plate, a longitudinal reflector plate and a bottom reflector plate which are brought into mutual orthogonal intersection at their diameters, further comprising:

a pair of half plates which comprises said lateral reflector plate, said pair of half plates being opposingly placed on both opposite sides of a rotation supporting shaft introduced therebetween, another pair of half plates which comprises said longitudinal reflector plate, said pair of half plates being opposingly placed on both opposite sides of said rotation supporting shaft therebetween, wherein said bottom reflector plate is placed at the longitudinal central part of said rotation supporting shaft, and an inclination supporting hole which is bored through said central part of said rotation supporting shaft with an inclination as to a longitudinal direction thereof, wherein the angle of said inclination is set to be equal to a detection design angle.

2. The rotational handy radar reflector according to claim 1, further comprising:

retaining claws provided to both opposite ends of diametrical edges of said pair of half plates comprising said lateral reflector plate and said pair of half plates comprising said longitudinal reflector plate, wherein said retaining claws are hooked onto both opposite ends of said rotation supporting shaft, and a plurality of foldable sector-shaped planes which comprise said bottom reflector plate, wherein each of said plurality of foldable sector-shaped planes is placed one by one between two of said half plates and connected to said two half plates by hinges.

3. A rotational handy radar reflector comprising:

a lateral reflector plate, a longitudinal reflector plate and a bottom reflector plate which are brought into mutual orthogonal intersection at their diameters, further comprising:

a rotation supporting shaft which passes through the center of said bottom reflector plate intersecting at its central portion, wherein said bottom reflector plate is provided with two horizontal slits and two vertical slits, each having a half length of the radius and formed in the direction from a circumferential edge to the center, a pair of half plates which comprises said lateral reflector plate, each of said half plates is provided with a horizontal slit having a half length of the radius and formed in the direction from the center to a circumference, each of said horizontal slits is respectively engaged with said horizontal slits of said bottom reflector plate, thereby opposingly placing said half plates at both right and left sides of said rotation supporting shaft, another pair of half plates which comprises said longitudinal reflector plate, each of said half plates is provided with a vertical slit having a half length of the radius and formed in the direction from the center to a circumference, each of said vertical slits is respectively engaged with said vertical slits of said bottom reflector plate, thereby opposingly placing said half plates at both top and bottom sides of said rotation supporting shaft, and an inclination supporting hole which is bored through said central portion of said rotation supporting shaft with an inclination as to a longitudinal direction thereof, wherein the angle of said inclination is set to be equal to a detection design angle.

4. The rotational handy radar reflector according to claim 3, further comprising:

a pole, wherein an insertion portion formed at the tip portion of said pole is inserted into said inclination supporting hole provided at the central portion of said rotation supporting shaft, thereby firmly fixing said shaft and pole, a holder, wherein the base end of said pole is inserted into said holder, thereby rotatably supporting said pole, and a motor fixed to said holder, said motor being connected to said pole through a transmitting device.

5. The rotational handy radar reflector according to claim 3, further comprising:

a pole, wherein an insertion portion formed at the tip portion of said pole is movably fitted into said inclination supporting hole provided at the central portion of said rotating supporting shaft.

* * * * *

UNITED STATES PATENT AND TRADEMARK OFFICE

CERTIFICATE OF CORRECTION

PATENT NO. : 6,061,012
DATED : May 9, 2000
INVENTOR : Kenjiro Sakimura

It is certified that error appears in the above-identified patent and that said Letters Patent is hereby corrected as shown below:

Column 2, line 17;
"ate" should be --plate--.

Column 3, line 34;
"clays" should be --claws--.

Column 5, line 64;
"15*b l of the pole 15*" should be --15b of the pole 15--.

Column 10, claim 5, line 54;
"rotating" should be --rotation--.

Signed and Sealed this

First Day of May, 2001

*Attest:*

Nicholas P. Godici

NICHOLAS P. GODICI

*Attesting Officer*

*Acting Director of the United States Patent and Trademark Office*